United States Patent [19]

Obrist et al.

[11] 4,252,248

[45] Feb. 24, 1981

[54] CONTAINER WITH COVER OF PLASTICS MATERIAL

[75] Inventors: Albert Obrist, Reinach; Hans-Werner Breuer, Balsthal, both of Switzerland

[73] Assignee: Albert Obrist AG, Reinach, Switzerland

[21] Appl. No.: 60,342

[22] Filed: Jul. 25, 1979

[30] Foreign Application Priority Data

Jul. 25, 1978 [CH] Switzerland ..... 7984/78

[51] Int. Cl.[3] ..... B65D 41/32

[52] U.S. Cl. ..... 220/270; 215/256; 220/306

[58] Field of Search ..... 220/270, 306; 215/256

[56] References Cited

U.S. PATENT DOCUMENTS

| | | | |
|---|---|---|---|
| 3,595,420 | 7/1971 | Miskin | 215/256 |
| 4,046,282 | 9/1977 | Ruch | 220/270 |
| 4,071,156 | 1/1978 | Lowe | 215/256 X |
| 4,103,803 | 8/1978 | Irvine | 220/270 |
| 4,111,329 | 9/1978 | Lampman | 215/256 X |

*Primary Examiner*—George T. Hall

*Attorney, Agent, or Firm*—Larson, Taylor and Hinds

[57] ABSTRACT

A container (1) is provided with a cover (2) which has a guarantee strip (4) which can be divided along a design tearing line. In this arrangement, the guarantee strip (4) engages under a holding bead (9) and at the same time is protected from unauthorized manipulation of the guarantee strip, by a protective bead (10). So that the container which is produced by an injection moulding process can be produced by means of axially openable moulding tools, the holding bead and the protective bead are interrupted in such a way, and are arranged offset relative to each other in gaps, in such a way, that the respective holding bead (9) only extends, on the outside wall of the container, over the length over which the protective bead (10) is interrupted. In this way there is no undercut configuration at any point, which would prevent axial retraction of the moulding tools or axial ejection of the container.

6 Claims, 7 Drawing Figures

CONTAINER WITH COVER OF PLASTICS MATERIAL

Figure 1:
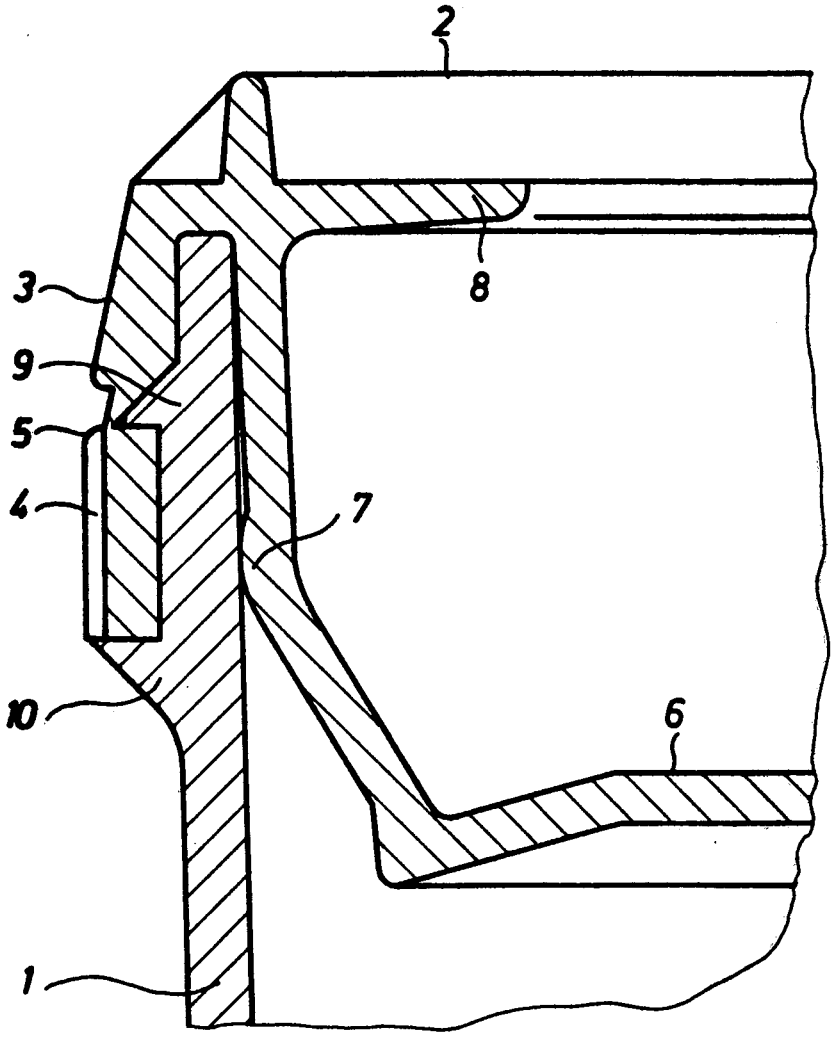

The invention relates to a container having a cover of plastics material, wherein at least the upper edge portion of the container is produced by an injection moulding process, which cover has a side wall which engages externally over the edge of the container, with a tear-off guarantee strip which engages under a holding bead on the outside wall of the container, in the region of a design tearing line, and which, at its lower boundary surface, adjoins a protective bead which is disposed on the outside wall of the container and which is parallel to the holding bead and whose outside diameter approximately aligns with the outside wall of the guarantee strip and protects the guarantee strip from below from damage by a force acting thereon.

Containers of this kind are used in practice in particular for packaging foodstuffs such as cocoa powder, coffee, fruitjuices and the like. On the onehand, the containers are required to protect the packaged contents from unauthorised access thereto, until the contents are to be used for the first time, but on the other hand, the containers are required to ensure that the containers are sealed in a liquid-tight manner, even after the containers have been opened for the first time. These problems are solved by means of the cover side wall which engages over the edge of the container, and the tear-off guarantee strip.

A container of this kind is described in detail for example in the applicants' DOS No. 21 98 796.7. The protective bead which is disposed below the guarantee strip is shown for example in U.S. Pat. No. 3,595,420 to B. L. Miskin. This protective bead covers the contact surface between the inside wall of the guarantee strip and the outside wall of the container and thus ensures that the guarantee strip cannot be lifted and slid over the holding bead, for example by use of a fingernail or the tip of a knife, without destroying the design tearing line of the guarantee strip when manipulating the guarantee strip in this way.

The disadvantage of the known containers is more particularly that arranging a holding bead and protective bead in the wall cross-section of the container results in the formation of an undercut configuration, in the form of a U-shaped channel, which seriously complicates the operation of removing the container from the injection moulding mould. In this respect, the container cannot be axially removed or ejected from the moulding tool, as either the holding bead 9 or the protective bead 10 prevents one half of the moulding tool from being withdrawn axially. Therefore, mould removal can only be effected in a moulding tool in which at least sections open radially and wherein the recess between the holding bead and the protective bead is separately removing from the mould. Radially opening injection moulding tools give rise to relatively high costs and also slow down the production process.

The problem of the present invention is therefore to eliminate the disadvantages of the known art and in particular to provide a container wherein axial mould removal is possible, without thereby impairing the proper function of the holding bead and the protective bead.

According to the invention, this problem is solved in that the protective bead is interrupted at at least two positions on its periphery and is subdivided into at least two segments, that the holding bead is also divided into at least two segments, and that the holding bead segments are arranged at an offset position in the spaces between each two protective bead segments.

It will be seen that this arrangement makes it possible for the separation line between the two outer tool portions to be established in such a way that each of the tool halves can be retracted in an axial direction, without the holding bead or the protective bead impairing the mould removal operation. As the holding bead only extends over the portions of the periphery of the container which are each disposed between two protective bead segments, one tool portion may extend between two respective holding beads, to the upper boundary surface of the protective bead which is disposed therebetween at a somewhat lower position. On the other hand, however, the adjoining tool portion may extend between the interrupted positions in the protective bead, to the lower boundary surface of the holding bead. In this arrangement, the tool separation edges extend alternately at the level of the holding bead segments and at the level of the protective bead segments.

The invention may be embodied in a particularly advantageous manner if the protective bead is interrupted at at least four positions, and if the interruptions at the periphery are disposed approximately diametrically opposite to each other. In this way, the cover of the container is held uniformly at four positions, without the sealing action of the container closure being impaired.

When the container is a square or rectangular container with rounded corners, it is particularly advantageous for the interruptions to be disposed at the four rounded corners. In the case of square or rectangular corners, the stress in the side wall of the cover, which engages over the wall of the container, is distributed differently from the stress in the case of round containers. In this connection, there is no pressure on the container wall, on the long sides of the container. However, a relatively high force is produced at the four corners of the container, which presses the guarantee strip firmly against the wall of the container. This function may be put to use in a particularly advanageous manner, with the arrangement according to the invention, by the absence of protective bead segments at the corners at which the guarantee strip lies firmly against the container and cannot be slid off without authorisation. The protective bead may be readily interrupted at these positions, as, because of the high stress at these points, it would not be possible in any case for the guarantee strip to be lifted over the holding bead, without tearing the weakened line in the guarantee strip. On the other hand, the protective bead extends over the long sides of the container, at which the guarantee strip can be relatively easily lifted away from the container wall.

In order also to protect the guarantee strip at the positions at which the protective bead is interrupted, the guarantee strip advantageously extends at an inclined angle towards the container wall, at its lower edge, in the region between two protective bead segments. This configuration means that there is virtually no surface for holding the guarantee strip of the purposes of lifting it off.

The degree of security at the unprotected segments of the guarantee strip is further increased if the guarantee strip is additionally provided with substantially vertically extending design tearing lines, in the region between two protective bead segments. This means that any manipulation at the unprotected positions on the guarantee strip results in rupture of the vertical tearing lines.

Figure 2:
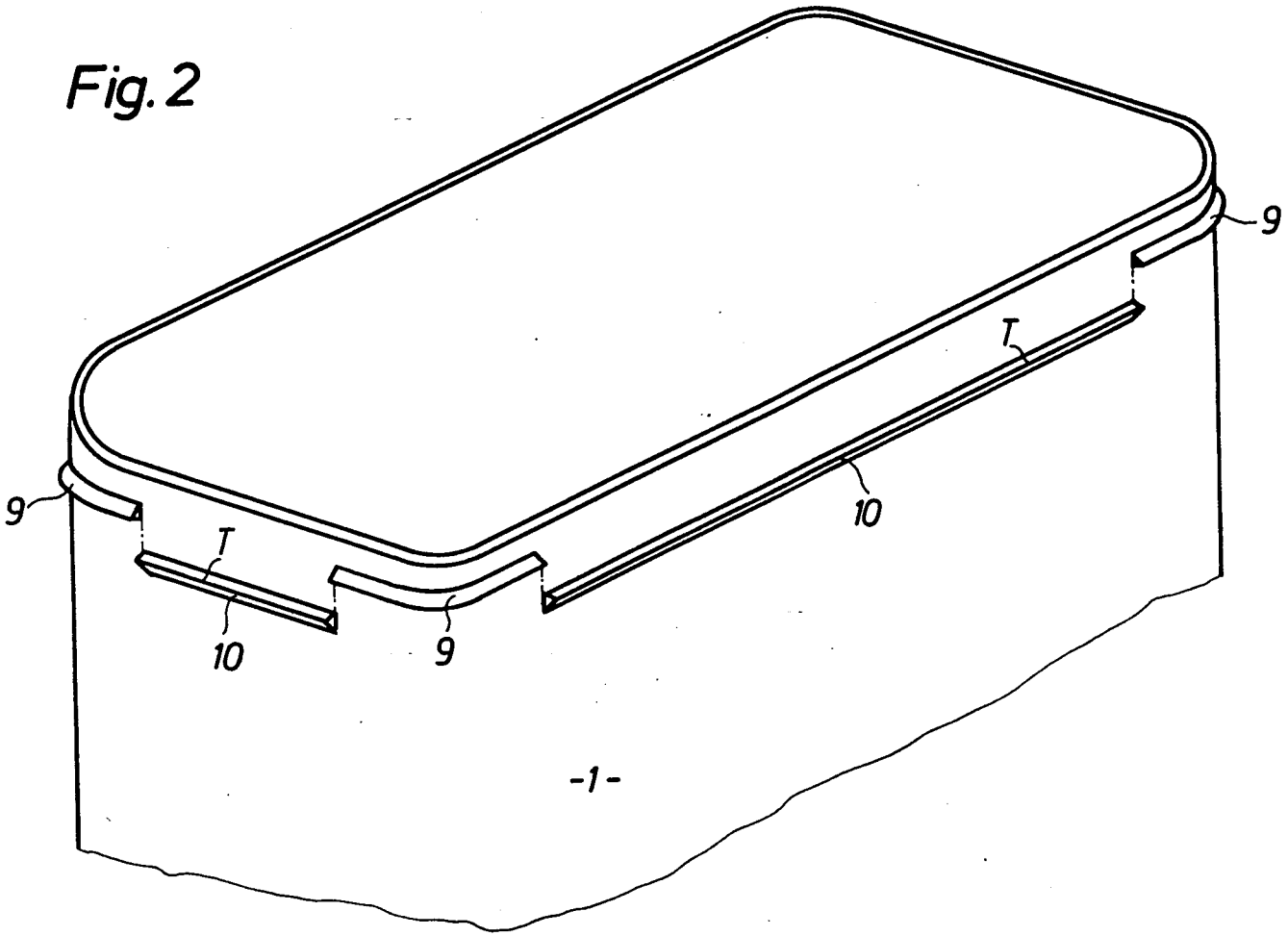
Figure 3:
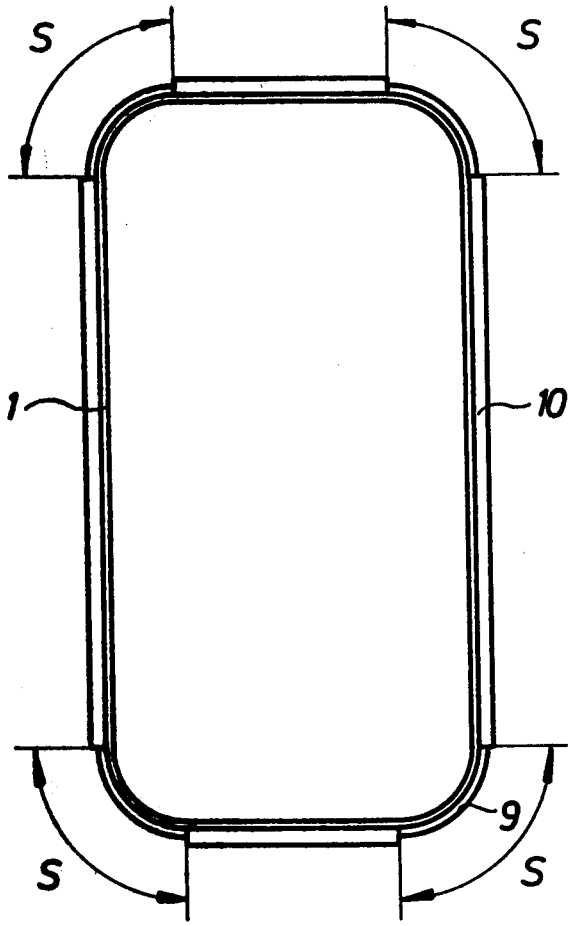
Figure 4:
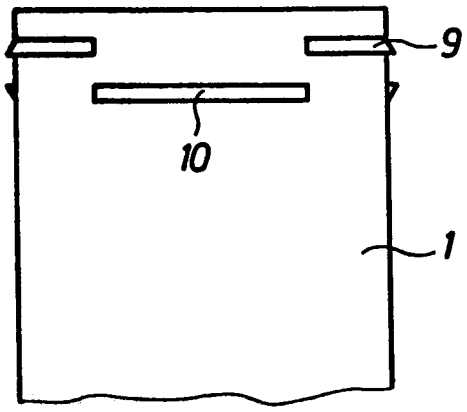
Figure 5:
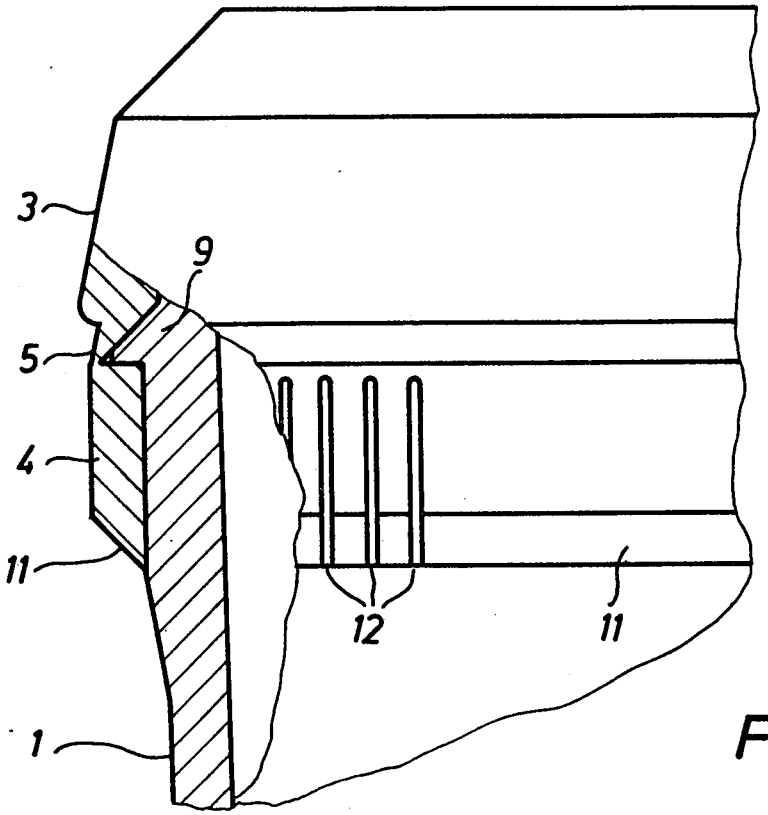
Figure 6:
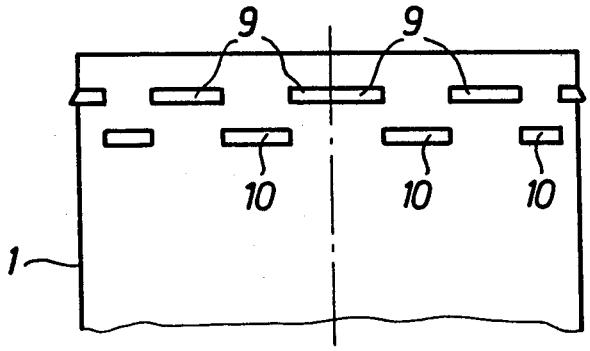

Embodiments of the invention are described in greater detail hereinafter and illustrated in the drawings, in which:

FIG. 1 shows a view in cross-section of part of a conventional container with cover, FIG. 2 shows a view of a container according to the invention, FIG. 3 shows a plan view of the container of FIG. 2, FIG. 4 shows a side view of the same container, FIG. 5 shows a partly sectional view of the corner portion of a square or rectangular container, FIG. 6 shows a modified embodiment with numerous interruptions, and FIG. 7 shows a view of an injection moulding tool in the open condition.

Referring to FIG. 1, a container 1 is closed by means of a cover 2 which has a side wall 3 engaging over the container wall, with a tear-off guarantee strip 4. The bottom portion 6 of the cover is arranged at a position in which it is sunk somewhat into the container, and a peripheral bead 7 which is pressed against the inside wall of the container reliably seals the container. A handle portion 8 also provides for easy handling of the cover. The guarantee strip 4 must be torn off along the design tearing line 5, when the container is to be opened for the first time. It is not possible for the container to be opened without authorization, without damaging the tearing line 5. As both the container and the cover have a certain degree of resiliency in their material, it would be theoretically possible to push a sharp object under the guarantee strip 4 and to push the guarantee strip 4 up over the holding bead 9. This however is prevented by the protective bead 10 which is approximately aligned with the outside of the guarantee strip 4. Any manipulation on the guarantee strip must therefore necessarily result in damage to the tearing line 5.

As can be particularly clearly seen from FIG. 1 which is a view in cross-section through a portion of a known container, in conventional containers there is a channel around the entire outside wall of the container, in which the guarantee strip 4 lies, between the holding bead 9 and the protective bead 10. This channel gives rise to serious problems in regard to producing the container by an injection moulding process, as the channel prevents the container from being removed or ejected axially from the mould. In order for the channel or the holding bead 9 and the protective bead 10 to be removed from the mould, the moulding tool must be opened radially, which gives rise to considerable trouble, both from the point of view of expense and also with regard to handling the moulding tool.

These disadvantages are eliminated by the arrangement of the holding bead and the protective bead, in accordance with the invention, as shown in FIG. 2. As illustrated, the protective bead 10 is subdivided into segments which are each interrupted at the rounded corners of the container 1. The holding beads 9 extend between the protective bead segments 10, on the periphery of the container. It will be seen that the holding bead segments 9 and the protective bead segments 10 are displaced relative to each other in such a way that the container 1 can be removed from a mould along a separating edge T without undercut configurations as for example a U-shaped channel as shown in FIG. 1 requiring the moulding tool to be opened radially.

As can be seen in particular from FIG. 3, the segments S at which the protective bead 10 is interrupted advantageously extend, in the case of a square or rectangular container, around the rounded corners of the container. With this container configuration, the highest pressing force in the cover occurs at the rounded corners, so that it is sufficient for the holding beads 9 to extend only over these segments.

As can be seen from FIG. 4, the length of the holding beads 9 precisely corresponds to the length of the individual interruptions in the protective bead 10, that is to say, the holding beads and the protective beads are arranged precisely offset relative to each other. Obviously, it would also be possible for the holding beads 9 to be shorter than the interruptions in the protective bead 10. Under no circumstances however can the holding beads 9 be longer than the interruptions in the protective bead 10 as otherwise an undercut cross-sectional configuration would be formed, which presents axial retraction of the moulding tools, at those positions at which the holding bead 9 overlaps the protective bead 10. Any desired number of interruptions and holding beads which are arranged at an offset position therein may be provided, in particular in round containers. The configuration of the holding bead and the protective bead may also be modified, without thereby departing from the scope of the invention. Thus, it is possible for example for the protective bead 10 to be formed, as shown in FIG. 1, as a continuous enlargement on the wall of the container, or for the protective bead to be moulded in the form of a separate bar member on to the wall of the container.

FIG. 5 shows a side view, partially in cross-section, of the corner portion of a square or rectangular container. As there is no protective bead segment 10 at this point, the guarantee strip 4 has an inclined end surface 11 which provides virtually no surface which can be gripped for lifting the guarantee strip. The guarantee strip may additionally be provided at the corner portion with vertical tearing lines 12 which immediately tear when a force is applied to the guarantee strip and thus indicate that the container has been subjected to unauthorized manipulation.

The modified embodiment shown in FIG. 6 has a multiplicity of alternately arranged holding bead segments 9 and protective bead segments 10 on a round container.

FIG. 7 is only a diagrammatic view of an injection moulding tool in the open condition, comprising a lower tool portion 13 and an upper tool portion 14. As shown, the separating edge T extends alternately on the protective bead segments 10 and the holding bead segments 9. It will be seen that the injection moulding tool shown makes it possible for the container 1 to be removed or ejected by an axial mould-removal operation, as the container does not have any undercut configurations.

After the injection moulding material has cooled, the lower tool portion 13 is first withdrawn. The inner portion (not shown) is then withdrawn through the opening 15. The container now only remains on the tool portion 14 from which it is ejected. The separating edge T desirably extends along the outermost projection of the protective and holding bead segments respectively. However, particularly when the beads are round, it is possible to have a slight deviation from the ideal line as long as there are no axial undercut configurations which prevent ejection of the container from the mould.

We claim:

1. A container having a cover of plastics material, wherein at least the upper edge portion of the container is produced by an injection moulding process, which cover has a side wall which engages externally over the edge of the container, with a tear-off guarantee strip which engages under a holding bead on the outside wall of the container, in the region of a design tearing line, and which, at its lower boundary surface, adjoins a protective bead which is disposed on the outside wall of the container and which is parallel to the holding bead and whose outside diameter approximately aligns with the outside wall of the guarantee strip and protects the guarantee strip from below from damage by a force acting thereon, characterized in that the protective bead (10) is interrupted at at least two positions on its periphery and is subdivided into at least two segments, that the holding bead (9) is also divided into at least two segments, and that the holding bead segments are arranged at an offset position in the spaces between each two protective bead segments.

2. A container with a cover according to claim 1 characterized in that the protective bead (10) is subdivided into at least four protective bead segments.

3. A container with cover according to claim 2 characterized in that the interruptions on the periphery of the container are disposed diametrically opposite to each other.

4. A rectangular or square container with rounded corners according to claim 3 characterized in that the holding bead segments (9) are arranged at the four rounded corners.

5. A container according to claim 1 characterized in that, in the region between two protective bead segments (10), the guarantee strip (4) extends at the lower edge at an inclined angle towards the wall of the container.

6. A container according to clam 1 characterized in that the guarantee strip (4) is additionally provided with substantially vertically extending design tearing lines (12), at least in the region between two protective bead segments (10).

* * * * *